United States Patent [19]

Edwards et al.

[11] Patent Number: 4,799,431

[45] Date of Patent: Jan. 24, 1989

[54] MODEL LOCOMOTIVE TRUCK MOUNTING MECHANISM

[75] Inventors: Clarence K. Edwards, Medford; Lawrence D. Edwards, Eagle Point, both of Oreg.

[73] Assignee: Kadee Metal Products Co., Medford, Oreg.

[21] Appl. No.: 112,938

[22] Filed: Oct. 26, 1987

[51] Int. Cl.[4] ..... B61D 17/00

[52] U.S. Cl. ..... 105/1.5; 105/49; 105/96; 105/157.1; 105/171; 105/182.1; 105/238.2; 446/469; 446/467

[58] Field of Search ..... 105/1.5, 29.1, 29.2, 105/49, 96, 108, 118, 119, 131, 132, 157.2, 171, 182.1, 199.1, 157.1, 238.2; 104/DIG. 288; 446/467, 447, 469

[56] References Cited

U.S. PATENT DOCUMENTS

| | | | |
|---|---|---|---|
| 3,120,080 | 2/1964 | Hahn | 446/447 |
| 3,918,198 | 11/1975 | Cheng et al. | 105/49 |
| 4,388,872 | 6/1983 | Girod et al. | 105/96 |

*Primary Examiner*—Andres Kashnikow
*Assistant Examiner*—Mark T. Le
*Attorney, Agent, or Firm*—Kolisch, Hartwell & Dickinson

[57] ABSTRACT

An improved truck mounting mechanism for a model railroad locomotive includes a gimbal body fixed to a wheel-bearing truck frame. A gimbal mount is provided for receiving the gimbal body. The gimbal mount is flexibly secured to the locomotive chassis and the gimbal mount and gimbal body are constructed and arranged to provide three-axis movement of the truck frame relative to the chassis.

13 Claims, 2 Drawing Sheets

MODEL LOCOMOTIVE TRUCK MOUNTING MECHANISM

This invention relates to model railroad locomotives and particularly to an improved truck mounting mechanism for mounting powered trucks on a locomotive chassis.

BACKGROUND OF THE INVENTION

Known model railroad locomotives, particularly model diesel-electric locomotives, are generally provided with powered trucks which serve as a collector for electricity running through a model railroad track. The locomotives are powered by small electric motors which are mechanically connected to the wheels to drive the locomotive over the rails. The locomotives are generally provided with a pair of trucks, in the front and rear of the locomotive, although some locomotives may be constructed which include more than two powered trucks. Known models include trucks which are mounted for movement about two axis relative to the locomotive chassis. Movement of trucks about only two-axis is adequate if the rails over which the locomotive moves are carefully laid and do not have any irregularities therein. However, and particularly in the case of the smaller scale, such as N gauge (1/160th scale) and Z gauge (1/220th scale) equipment, very minor irregularities in the track can create operational problems for the locomotives when the locomotives are equipped only with what is referred to herein as two-axis trucks.

Model railroad track is usually constructed from a pair of spaced apart conductive rails, which are generally made of brass or a nickel-silver alloy, and which are mounted on plastic ties The ties are joined together in either a flexible or rigid configuration. The ties and rails may be secured to a roadbed, or the ties and the roadbed may be integrally formed. The rails are secured to the ties by molded plastic "spikes", which are somewhat flexible and allow irregularities, which are visually imperceptible, to be present in what appears to be even, level track. Additionally, where the track is provided with turnouts, crossovers, grade changes or banked curves, additional irregularities occur.

The existence of irregularities in the track surface presents problems in operation of the model locomotives in that if some of the wheels of the locomotive lose contact with the rail, the electrical connection between the wheels, and hence the locomotive, and the rails is degraded. Additionally, the ability of the locomotive to pull the cars of the train attached thereto is degraded because less pulling force is exerted when all of the wheels are not in positive contact with the rails.

SUMMARY OF THE INVENTION

The instant invention provides means for mounting a truck to a locomotive chassis which provides three-axis, completely flexible movement of the truck relative to the locomotive chassis. The invention provides, in a model railroad locomotive for self-propelled movement over a pair of electrically conductive, spaced apart rails, wherein the locomotive has an elongate chassis and motor means therein, an improved truck mounting mechanism which includes at least two truck frames having wheel-bearing axles carried thereon, first truck frame mounting means for providing two-axis movement of one truck frame relative to the chassis and second truck frame mounting means for providing three-axis movement of another truck frame relative to the chassis.

An object of the instant invention is to provide a truck mounting mechanism which provides improved wheel/rail electrical contact.

Another object of the instant invention is to provide a truck mounting mechanism which equalizes the load on each wheel of the truck.

A further object of the instant invention is to provide a truck mounting mechanism which promotes maximum contact between the wheels on the truck and an irregular track.

Yet another object of the instant invention is to provide a truck mounting mechanism which is easy and inexpensive to produce and which may be easily adapted to existing locomotives.

DETAILED DESCRIPTION OF A PREFERRED EMBODIMENT

Figure 1:
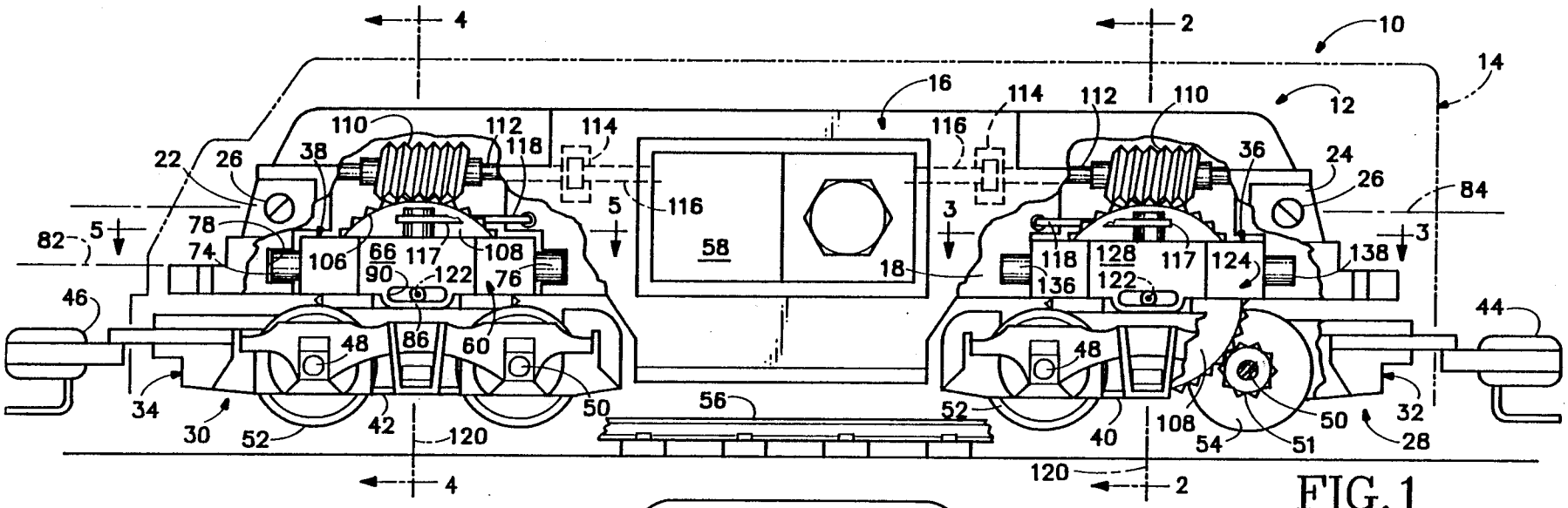
FIG. 1 is a side plan view of a locomotive chassis incorporating the improved truck mounting mechanism of the invention, with portions broken away to show detail.

Turning initially to FIG. 1, a model railroad locomotive incorporating the improved truck mounting mechanism of the invention is shown generally at 10. Locomotive 10 includes a chassis 12 which is covered by a body or shell 14 (shown in phantom) to provide the locomotive with a lifelike appearance.

Figure 2:
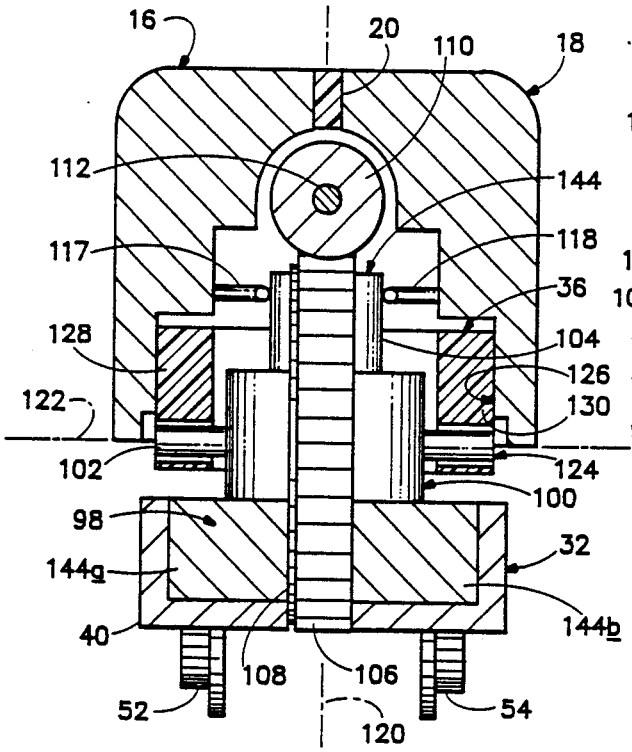
FIG. 2 is an enlarged end sectional view of the chassis of FIG. 1, taken generally along the line 2—2, showing first truck frame mounting means.

Chassis 12, and now referring to FIGS. 1 and 2, includes a left half 16 and a right half 18. In the preferred embodiment, the halves of the chassis are formed of an electrically conductive material and are separated by an insulative material 20 to prevent electrical contact between the two halves of the chassis. The two halves of the chassis are held together by a pair of non-electrically conductive chassis guides 22, 24 which are secured to the chassis halves by screws 26. Screws 26 extend through the chassis guide and into one half only of the chassis, thereby maintaining the insulated relationship between the chassis halves.

Locomotive 10 rides on a pair of truck assemblies, such as first truck assembly 28, which is located at the rear of locomotive 10, and second truck assembly 30, which is located at the front of the locomotive. The truck assemblies include truck frames, such as first truck frame 32 and second truck frame 34 and truck mounting means, such as first truck frame mounting means 36 and second truck frame mounting means 38.

Figure 4:
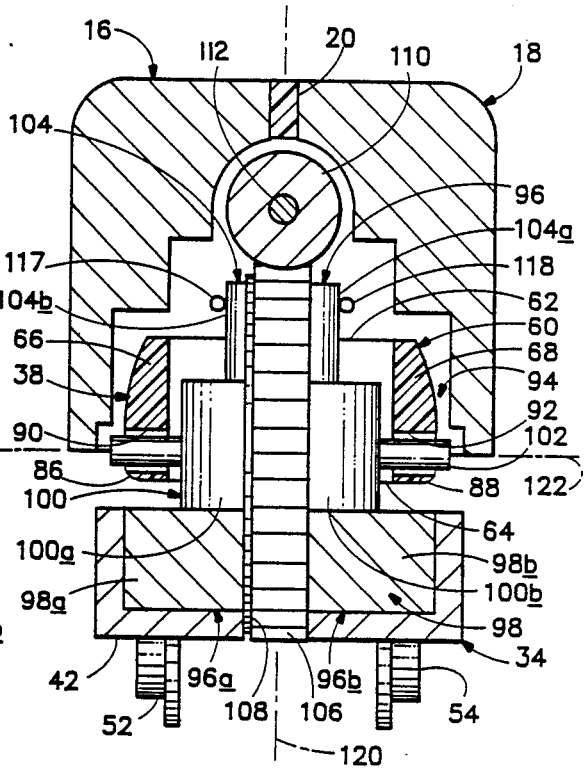
FIG. 4 is an enlarged end sectional view of the improved truck mounting mechanism of the invention, taken generally along the line 4—4 of FIG. 1.

First and second truck frames 32, 34 are substantially identical structures and include, and now referring to FIGS. 1, 2 and 4, frameworks 40, 42 having couplers 44, 46, respectively, carry thereon. Couplers 44, 46 are operable to connect the locomotive to another locomotive or to rail cars which are drawn by the locomotive.

Each framework has a pair of axles 48, 50 extending therethrough. Each axle has a flanged wheel, such as wheels 52, 54 secured at an end thereof, and an axle gear 51 located thereon. Axles 48, 50 are formed of non-conductive material to provide insulation between wheels 52, 54, which are electrically conductive and which serve as a means by which electricity is conducted from the rails, such as rail 56, to a motor 58, also referred to herein as motor means, which drives locomotive 10. The full circuit for conducting electricity from rail 56 to motor 58 will be described later herein.

Figure 5:
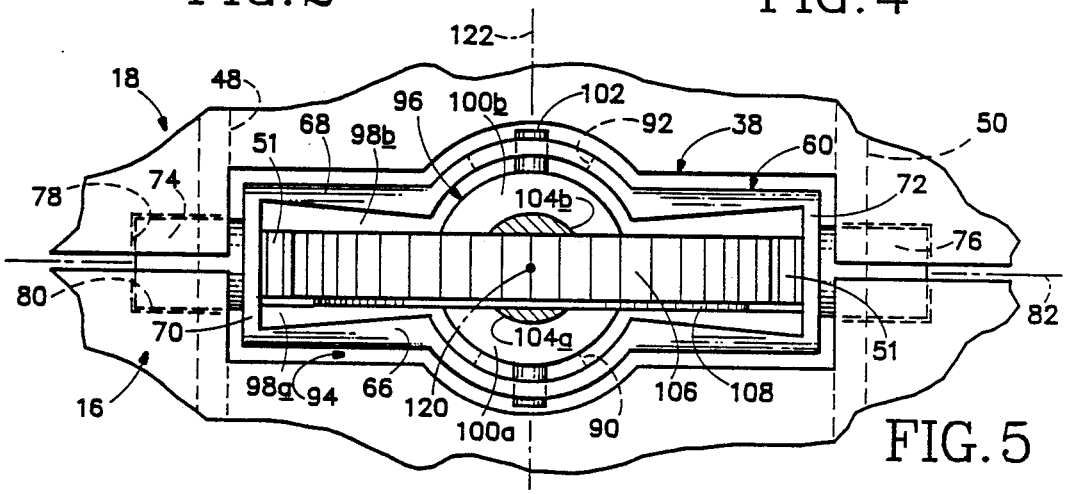
FIG. 5 is a greatly enlarged top plan view of the mechanism of FIG. 4, taken generally along the line 5—5 of FIG. 1.

Turning now to FIGS. 1, 4, and 5, second truck frame mounting means 38 will be described in greater detail. Mounting means 38 is constructed to provide a three-axis movement of truck frame 34 relative to chassis 12. Second truck frame mounting means 38 includes a gimbal mount 60 which is flexibly secured to chassis 12. Gimbal mount 60 is a substantially boxlike structure having an open top 62, an open bottom 64, and opposed, spaced apart sides 66, 68. Sides 66, 68 have an arcuate exterior surface extending between the top and the bottom of the mount. The mount also includes opposed, spaced apart ends 70, 72 which carry pivot pins, or pivot means, 74, 76, respectively. Pivot pins 74, 76, also referred to herein as roll movement means, are received in chambers 78, 80, respectively, which are formed in the right and left halves of the chassis, respectively, and allow movement of gimbal mount 60 about a roll axis 82, which is substantially parallel to a chassis axis 84. Pin 74, 76, therefore provide means for securing the gimbal mount to the chassis and additionally provide for roll movement of the gimbal mount relative to the chassis.

A pair of opposed flanges 86, 88 extend downward from the sides 66, 68 of gimbal mount 60 and have therein elongate apertures 90, 92, respectively, which extend substantially parallel to roll axis 82. Gimbal mount 60 is received in an area 94 of chassis 12 which allows for the rolling movement of gimbal mount 60 relative to the chassis.

A gimbal body 96, having a left half **96*a* and a right half 96*b*, is received in gimbal mount 60. Gimbal body 96 is formed of electrically conductive material. Gimbal body 96 includes a lower, elongate portion 98, with halves 98*a*, 98*b*, which receives framework 42 thereon. Framework 42 is fixed to elongate portion 98, as by screws (not shown). A central portion 100, having halves 100*a*, 100*b*, extends upward from elongate portion 98 and has articulation means 102 extending therethrough and into apertures 90, 92 in gimbal mount 60. An upper portion 100, having halves 104*a*, 104*b*, is located atop central portion 100**.

A worm gear 106 is sandwiched between the two halves of gimbal body 96 and turns on articulation means 102. A worm gear insulator 108 (shown with greatly exaggerated thickness) is located on one side of gear 106 and is operable to insulate the right half of the gimbal body from the left half thereof. Worm gear 106 drives axle gears 51, which are connected to axles 48, 50 and, in turn, wheels 52, 54. Worm gear 106 is driven by worm 110 which is carried on a worm-to-bellgear shaft 112. A bellgear mechanism 114 is driven by a shaft 116 which comes directly off of motor 58. Thus, motor 58 is operable to drive wheels 52, 54 through he aforementioned gear and shaft arrangement thereby propelling the locomotive over the tracks under the locomotive's own power.

The electrical connection between the rails and motor 58 begins with contact between conductive wheels 52, 54 and the rails. The wheels in turn energize the right and left halves of the gimbal bodies. Electrical contacts 117, 118 are secured to chassis halves 16, 18, respectively, which in turn conduct the electricity to the poles of motor 58.

Articulation means 102 is operable with apertures 90, 92 to provide two-axis movement of the gimbal body relative to the gimbal mount. Gimbal body 96 is free to move about a yaw axis 120 and also to move about a pitch axis 122. Thus, the gimbal mount and gimbal body of the second truck frame mounting means are operable to provide three-axis movement of truck frame 34 relative to chassis 12.

Figure 3:
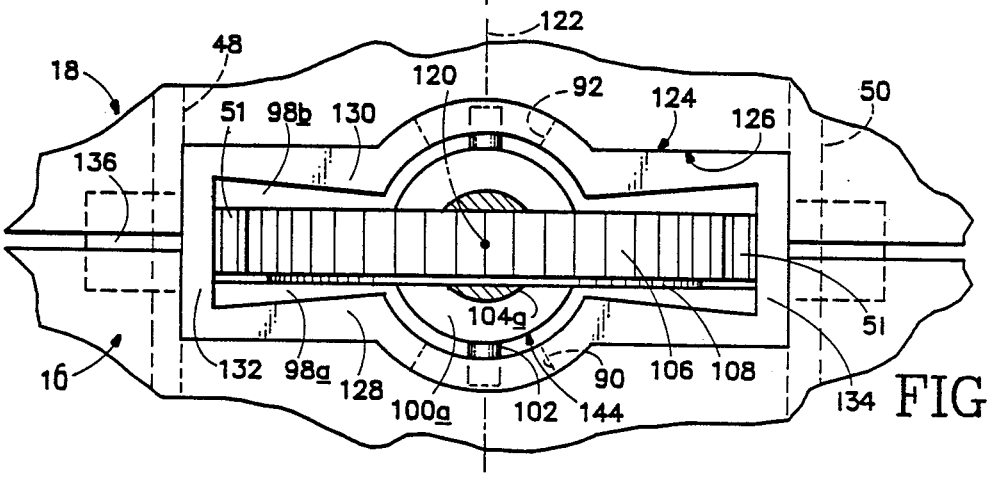
FIG. 3 is a greatly enlarged top plan view of the mounting means of FIG. 2, taken generally along the line 3—3 of FIG. 1.

Referring now to FIGS. 1, 2, and 3, first truck frame mounting means will be further described. First truck frame mounting means is conventional in design and includes a gimbal mount 124 which is snuggly received in an area 126 of chassis 12, which has substantially the same dimensions as area 94. Gimbal mount 124 includes opposed sides 128, 130, ends 132, 134 and has an open top and an open bottom. Pins 136, 138 are attached to ends 132, 134, respectively, and extend into chambers 140, 142 which are substantially like chambers 78, 80, in chassis 12, for additionally securing gimbal mount 124 to chassis 12. Gimbal mount 124, however, is not free to move about a roll axis in that the outer edges of sides 128, 130 are formed in a planar fashion and are received in a non-flexible manner in area 126 of chassis 12.

A gimbal body 144, which is substantially identical to gimbal body 96, is received in gimbal mount 124, and the components thereof are identified by like numbers.

Figure 6:
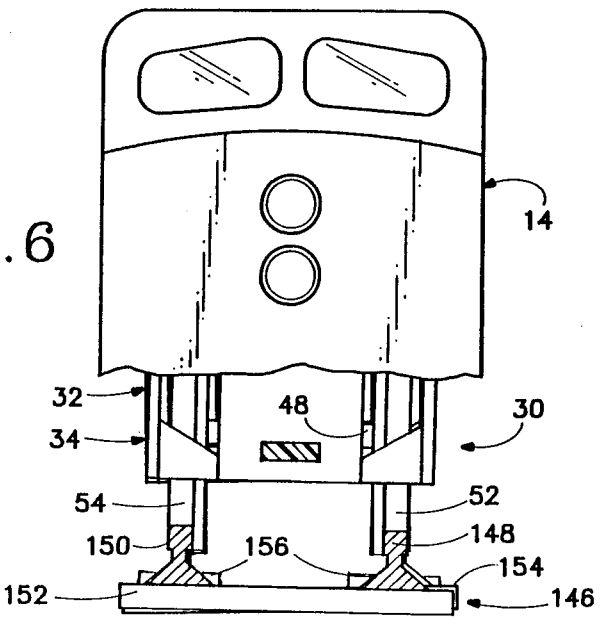
FIG. 6 is an environmental view of a model railroad locomotive incorporating the improved truck mounting mechanism of the invention, with portions broken away to show detail.

Turning now to FIG. 6, locomotive 10 is depicted in an environmental situation traveling on a track 146 which includes a pair of spaced apart rails 148, 150. Rails 148, 150 are secured to ties, such as tie 152 and tie 154. In the usual track assembly, ties 152, 154 are formed of a plastic material while rails 148, 150 are formed of a brass material or a nickel-silver alloy. Rails 148, 150 are secured to the ties by means of "spikes" 156, which are formed with the tie in a molding process.

As indicated in FIG. 6, a slight irregularity exists between the level of tracks 148, 150 as a result of unevenness of ties 152, 154. This irregularity presents no problem to a locomotive constructed according to the invention because the rear truck assembly, which is constructed for movement about two axis, is able to maintain all four of its wheels on the rails while the front truck assembly, which is constructed for movement about three-axis, is also able to maintain all four of its wheels in contact with the rail. This construction allows for more positive contact between the wheels and the rails, thereby promoting the flow of electrical current between the rails and the motor and a greater coefficient of friction between the locomotive and the rails, which occurs when all of the wheels are in positive contact with the rails.

In the case of a model locomotive which has more than two truck assemblies mounted thereon, at least one of the truck assemblies should have the configuration of the first truck assembly described herein to maintain the locomotive in an upright condition relative to the rails.

Although it is sufficient for only one wheel on one side of the locomotive to be in electrical contact with the rail, such a situation is undesirable as a more positive electrical contact is made when all of the wheels on a side of the locomotive are in electrical contact with the respective rail. Additionally, a greater amount of pulling force is provided by the locomotive when all of its wheels are in contact with the rail because of a greater coefficient of friction between the locomotive and the rail.

The three-axis movement of the second truck assembly described herein provides for substantially all-wheel contact between the locomotive and the rails in spite of any irregularities in the height of the rails. The weight of the locomotive will be equalized on the wheels of the three-axis assembly. Additionally, the locomotive will at certain times encounter portions of the rail which are not powered, such as might be found in turnouts and crossovers, or, which might be encountered when a portion of the rail may have foreign, nonconductive matter thereon. The provision of an assembly such as the first truck assembly provides for stability of th locomotive while the construction of the second truck assembly insures maximum contact between the wheels of the locomotive and the rails.

The provision of gimbal mount 60 enables a three-axis assembly as has been described to be retrofitted into existing locomotives which were initially constructed using a conventional two-axis assembly. To facilitate movement of gimbal mount 60 about roll axis 82, pins 74, 76 may be formed with dimensions slightly smaller than those of pins 136, 138 of gimbal mount 124 to insure low-friction movement of the mount in chambers 78, 80.

Although a preferred embodiment of the invention has been described herein, variations and modifications may be made thereto without departing from the scope of the invention as defined in the appended claims.

It is claimed and desired to secure as Letters Patent:

1. In a model railroad locomotive for self-propelled movement over a pair of spaced apart rails and having a chassis and motor means, and improved truck mounting mechanism comprising:

a truck frame having wheel-bearing axles carried thereon;

a gimbal body fixed to said truck frame; and a gimbal mount for receiving said gimbal body, wherein said gimbal mount is flexibly secured to the locomotive chassis, said gimbal mount and gimbal body being constructed and arranged to allow said truck frame to pivot on three axes fixed relative to the chassis.

2. The mechanism of claim 1 wherein said gimbal body has articulation means thereon and said gimbal mount has receiving means for receiving said articulation means, said articulation means and receiving means being constructed and arranged to provide pitch and yaw movement of said gimbal body relative to said gimbal mount.

3. The mechanism of claim 1 wherein said gimbal mount has roll movement means thereon for providing roll movement of said gimbal mount about a roll axis relative to the chassis.

4. In a model railroad locomotive, for self-propelled movement over a pair of electrically conductive, spaced apart rails, the locomotive having a elongate chassis, and motor means, an improved truck mounting mechanism comprising:

at least two truck frames having wheel-bearing axles carried thereon;

first truck frame mounting means for allowing one truck frame to pivot on two axes fixed relative to the chassis; and second truck frame mounting means for allowing another truck frame to pivot on three axes fixed relative to the chassis.

5. The mechanism of claim 4 wherein said second truck frame mounting means includes a gimbal mount having roll movement means thereon for providing roll movement, relative to the chassis, of said gimbal mount about a roll axis, said roll axis being substantially parallel to the longitudinal axis of the chassis.

6. The mechanism of claim 5 wherein said gimbal mount is a substantially box-like structure having an open top and base, and opposed, spaced apart ends and sides, said sides have an arcuate exterior surface between said top and said base, and wherein said roll movement means are located on either end of said gimbal mount.

7. The mechanism of claim 5 wherein said second truck frame mounting means further includes a gimbal body fixed to said other truck frame, said gimbal body having articulation means thereon providing two-axis movement of said gimbal body relative to said gimbal mount.

8. The mechanism of claim 7 wherein said gimbal mount includes a pair of opposed, elongate apertures therein extending substantially parallel to said roll axis and said articulation means are receivable in said apertures for providing pitch and yaw movement of said gimbal body relative to said gimbal mount.

9. The mechanism of claim 8 wherein said gimbal body includes an elongate structure for mounting said truck frame thereon, a central portion through which said pivot means extend, and an upper portion for providing electrical contact between said mounting means and the locomotive chassis.

10. In a model railroad locomotive for self-propelled movement over a pair of electrically conductive, spaced apart rails, the locomotive having an elongate chassis, and motor means, an improved truck mounting mechanism comprising:

at least two truck frames having wheel-bearing axles carried thereon;

first truck frame mounting means for providing two-axis movement of one truck frame relative to the chassis; and second truck frame mounting means for providing three-axis movement of another truck frame relative to the chassis, including a gimbal mount secured to the chassis for movement about a roll axis, said roll axis being parallel to the longitudinal axis of the chassis, and a gimbal body fixed to the second truck frame, said gimbal body having articulation means thereon and said gimbal mount having receiver means for receiving said articulation means, said articulation means and receiver means being constructed and arranged to provide pitch and yaw movement of said gimbal body relative to said gimbal mount.

11. The mechanism of claim 10 wherein said gimbal mount is a substantially box-like structure having opposed, spaced apart ends and opposed spaced apart sides, and said receiver means includes a pair of opposed, elongate apertures, extending substantially parallel to the roll axis, formed in said ides intermediate the ends thereof; and said articulation means is constructed and arranged to retain said gimbal body in said gimbal mount, said articulation means extending into said apertures on either side of said gimbal mount.

12. The mechanism of claim 11 wherein said sides of said gimbal mount have an arcuate exterior surface between the top and bottom thereof and wherein means are provided on each end of said gimbal mount for securing said gimbal mount to the chassis, said means for securing being constructed and arranged to provide movement of said gimbal mount about said roll axis.

13. The mechanism of claim 12 wherein said gimbal body includes an elongate structure for mounting said truck, frame thereon, a central portion through which said articulation means extend, and an upper portion for providing electrical contact between said mounting means and the locomotive chassis.

* * * * *